United States Patent [19]

Wokal

[11] Patent Number: 5,028,007

[45] Date of Patent: Jul. 2, 1991

[54] SHOWER PIPE ASSEMBLY

[75] Inventor: Keith A. Wokal, Ridgefield, Wash.

[73] Assignee: LaValley Industries, Inc., Vancouver, Wash.

[21] Appl. No.: 400,998

[22] Filed: Aug. 31, 1989

[51] Int. Cl.[5] ..... B05B 1/14; B05B 1/26

[52] U.S. Cl. ..... 239/518; 239/550; 239/600

[58] Field of Search ..... 239/518, 550, 551, 600; 285/161, 200–209

[56] References Cited

U.S. PATENT DOCUMENTS

| | | | |
|---|---|---|---|
| 1,847,058 | 2/1932 | Yonohonko | 285/161 X |
| 2,204,802 | 6/1940 | Gessler | 239/550 |
| 3,150,082 | 9/1964 | Rich | 210/395 |
| 3,363,774 | 1/1968 | Luthi | 210/404 |
| 4,058,261 | 11/1977 | Pollart | 239/550 X |
| 4,248,716 | 2/1981 | LaValley | 210/402 |
| 4,276,169 | 6/1981 | Browne et al. | 210/404 |
| 4,370,231 | 1/1983 | LaValley | 210/404 |
| 4,522,716 | 6/1985 | LaValley | 210/210 |
| 4,670,099 | 6/1987 | LaValley | 162/60 |
| 4,697,292 | 10/1987 | LaValley | 8/156 |
| 4,699,217 | 10/1987 | McLennan et al. | 239/600 X |
| 4,738,401 | 4/1988 | Filicicchia | 239/600 |
| 4,795,558 | 1/1989 | LaValley | 210/217 |

FOREIGN PATENT DOCUMENTS

| | | | |
|---|---|---|---|
| 1020608 | 8/1977 | Canada | 239/550 |
| 3632005 | 4/1988 | Fed. Rep. of Germany | 239/600 |

*Primary Examiner*—Andres Kashnikow
*Assistant Examiner*—Kevin P. Woldon
*Attorney, Agent, or Firm*—Marger, Johnson, McCollom & Stolowitz, Inc.

[57] ABSTRACT

The shower pipe assembly of the present invention can be used in a washing device such as a rotary drum filter and comprises an elongate pipe member including means defining a hollow interior flow chamber, preferably located adjacent a washer device, for conveying a wash liquid, preferably a liquid for washing a pulp mat. The shower pipe includes at least one row of spray holes extending through the pipe from the interior flow chamber to the exterior thereof. It also comprises a spray diffusion flange assembly extending from the pipe member adjacent each of the spray holes and further includes apparatus for impermanently attaching the diffusion flange to, and detaching the diffusion flange from, the pipe member, preferably to the exterior of the pipe member. These attachment and detachment steps are carried out without the use of auxiliary internal connecting apparatus which are not part of the diffusion flange structure.

17 Claims, 2 Drawing Sheets

SHOWER PIPE ASSEMBLY

BACKGROUND OF THE INVENTION

The present invention relates generally to a shower pipe assembly for spraying a liquid, particularly to shower pipe assembly for use as a washer or spraying device, and more particularly to a shower pipe assembly for washer devices comprising rotary drum filters.

Devices for spraying liquids such as washing fluids are well known in the prior art. For example, conventional washer devices include pressure washers and belt washers. Other known washer devices are rotary drum filters are commonly used in the pulp and paper industry for dewatering and washing a pulp slurry. Such filters include a rotary drum partially submerged in a tank of pulp slurry. The drum surface is conventionally covered by a filter screen. As the screen rotates through the pulp slurry, a vacuum is applied within a portion of the drum, collecting a wet mat of fibers from the slurry on the screen. As the screen emerges from the tank, slurry liquid or filtrate is drawn inwardly through the screen by the vacuum and discharged through suitable piping, thereby removing the liquid from the mat. Examples of such filters are disclosed generally in U.S. Pat. No. 4,276,169 to Browne, et al., U.S. Pat. No. 4,248,716 to LaValley, U.S. Pat. No. 4,370,231 to LaValley, and in the patents cited therein.

Conventionally, about half a dozen parallel shower pipes are angularly spaced around a segment of the drum extending from just above the surface of the slurry to the top of the drum, proceeding in the direction of drum rotation. These pipes extend axially of the drum and are supported adjacent the ends of the drum. Washing liquid is discharged in a spray from the shower pipes to wash the pulp fibers as the mat emerges from the slurry. The pipes are spaced a fixed radial distance from the filter screen. This distance is preferably constant along the length of the pipes so that spray intensity and distribution are substantially uniform all the way across the mat. Examples of such shower pipes are disclosed in U.S. Pat. Nos. 3,150,082 to Rich and 3,363,774 to Luthi.

One persistent problem in the design and manufacture of rotary drum filters for use in pulp manufacture is the mitigation of corrosion. This problem has been overcome in part by making as many components of the filters as possible of corrosion-resistant material, such as fiberglass reinforced plastic. However, some prior attempts at making shower pipes of fiberglass reinforced plastic have suffered from several drawbacks.

One drawback is a tendency of the pipes to sag. Conventional drum filters are very long, often 20 feet or more. To span the length of the drum, the shower pipes must be even longer. Such pipes are ordinarily supported only at their ends and, during operation, are filled with washing liquid. Consequently, they must be extremely stiff to minimize sagging between their ends. Prior shower pipes, constructed of fiberglass reinforced plastic alone and having a cylindrical cross section, are not sufficiently stiff to resist sagging.

Therefore, to increase stiffness in the vertical plane, it has been proposed to provide such pipes with a vertical fin or "stiff back" along one side. However, each pipe must be rotationally positioned so that its spray outlets or nozzles direct the spray against the mat at about the same angle of incidence. The rotational position thus varies with the angular position of each pipe around the drum. Applying a stiff back on all pipes in the same position relative to the spray outlets would defeat the purpose of the stiff back in the pipes that are rotationally positioned with stiff back approaching horizontal. Depending on pipe spacing, such positioning might also be precluded by interference between the stiff back of one pipe and an adjacent pipe. Hence, to be effective, this proposal would require making a different configuration pipe for each angular position around the drum.

Various shower pipe designs having steel angle members or stiffeners imbedded in the plastic at angular intervals around the pipe have also been tried, but still sag unacceptably. In one example, a 17 foot long cylindrical shower pipe, reinforced with three steel angle members, exhibited substantial sag when supporting a static load of 100 pounds midway between its ends.

Another problem involves the spray pattern of washing liquid discharged from the shower pipes. It is desirable to wash the mat uniformly, necessitating continuous spray coverage along the axial length of the drum. However, since the mat is typically thin and fragile, care must be taken to avoid tearing it with excessive localized spray intensity. Accordingly, a variety of different spraying arrangements have been proposed. One such arrangement uses a single row of spray holes spaced along the length of the pipe, together with some means for diffusing the spray from each hole to provide overlapping coverage. One form of diffusing means is a continuous lip or flange positioned along the row of holes and extending outwardly from the pipe to cause the spray from each hole to fan out. This approach is unsatisfactory because it concentrates too much spray pressure where overlapping adjacent fans of spray both strike the mat, often tearing the mat. Other forms of diffusing means include a whistle-type nozzle and a spoon-type diffuser positioned alongside each spray outlet. The latter forms of spray diffusers have also been tried in conjunction with double rows of longitudinally staggered holes. However, in practice, they do not provide sufficiently uniform spray coverage and are susceptible to plugging, particularly by fiber back-spattering from the mat into the spray outlets by the spray. Changing the size of these nozzles does not substantially change the flow rate of the spray stream.

An additional disadvantage is the difficulty of making the foregoing shower pipe designs of fiberglass reinforced plastic using conventional manufacturing techniques. Heretofore, fiberglass reinforced plastic washer pipes have been formed on a cylindrical mandrel. Once a cylindrical pipe is formed, steel stiffeners are applied to its outer surface and overlain with additional fiberglass reinforced plastic material. Next, cylindrical spray holes are drilled in a row along a side of the pipe. Finally, a diffuser flange is positioned along the row of holes and secured to the pipe. This process produces a pipe having a rough and uneven outer surface. Such a surface precludes accurate positioning of the diffuser flange relative to the row of holes, thereby causing uneven diffusion of the spray. This process also renders virtually impossible the formation of complex shapes of spray holes or nozzles. And the resultant product has the functional drawbacks described above, namely, sagging and taring the mat.

Many of the foregoing problems are eliminated by the shower pipes manufactured by LaValley Industries, Inc., the assignee of the entire interest in this application, which are described in U.S. Pat. No. 4,522,716, U.S. Pat. No. 4,670,099, U.S. Pat. No. 4,697,292 and U.S. Pat. No. 4,795,558. For example, in U.S. Pat. No. 4,522,716, the shower pipe is made of fiberglass reinforced plastic and has a rectangular cross-section providing substantial rigidity against sagging between the ends of the pipe regardless of the rotational orientation of the pipe along a rotary drum filter. The pipe is stiffened by a pair of structural connecting flanges which extend along opposite sides of the pipe and provide rigidity to prevent the pipe from sagging. The pipe also includes reinforcing rods which extend along the interior corners of the pipe, also to provide rigidity against sagging.

Such pipes are preferably formed by molding them in channel-shaped half sections which are subsequently joined together along their connecting flanges. Spray holes are machined in one of the half sections in two parallel rows in which the holes of one row are staggered from the holes of the other row. Continuous diffusion members extend along each row so as to diffuse the discharges of liquid from each row of holes into two different planes. In this way, overlapping spray coverage is obtained without any overconcentration of spray at any point on the mat. The spray holes have a constricting frustoconical shape to better diffuse the discharge of liquid onto the diffusion members.

Although the LaValley shower pipe of U.S. Pat. No. 4,522,716 is a great improvement over known prior shower pipes, its integral essentially all fiberglass construction is laborious and expensive to manufacture, and requires laborious machining of each spray hole. Furthermore, while the continuous diffusion flanges along each row of spray holes are an improvement over prior hole-diffuser arrangements, the diffusion pattern they produce leaves room for more improvement.

U.S. Pat. No. 4,795,558, which is assigned to the common assignee of this application and is incorporated herein by reference, is directed to a rigid elongate pipe made of fiberglass-reinforced plastic. Spray holes extend in spaced apart relationship axially along the pipe, the holes extending through an outer wall of the pipe for discharging a liquid spray line along the length of the pipe when it is filled with a liquid under pressure. The pipe is generally fabricated in two channel-shaped half sections bonded together along flanges to define a pipe of rectangular section with structural rigidifying flanges extending along opposite sides. The pipe may also be fabricated in two angle-shaped half sections bonded together along flanges also to define a pipe of rectangular section, but with structural rigidifying flanges at diagonally opposite corners.

The individual diffusion flanges set forth in the U.S. Pat. No. 4,795,588 patent, are internally-mounted. In providing the requisite diffused flange member-containing shower pipes (see FIGS. 8 and 10 of U.S. Pat. No. 4,795,558) the frustoconical spray holes and associated diffusion flanges are formed as separate preformed injection-molded plastic members 148, 146 which are assembled together at corresponding straight-bored holes 145 through bottom wall 122 of the lower pipe section before the two pipe sections are joined together. A primary reason for employing the respective two-pipe sections is to enable attachment of plastic members 148 and 146 one to the other. More specifically, member 146 is a diffusion lip or flange which extends from the outside or underside of pipe 110. Member 148 comprises a hollow insert nut, which includes an enlarged hex head 150 joined to an externally threaded shank 152, seats against the inside surface of bottom wall 122, and threadingly engages internal threads 160 on shank 152 of insert 148. Therefore, one must have access to the internal portion of bottom wall 122 in order to join members 148 and 146 together. However, the use of a two-piece body causes certain problems. First, it is more expensive to built a two-piece body. Secondly, a two-piece body has approximately 20% the hydraulic burst pressure strength of a comparable one-piece body. Shower failure (burst) under pressure accounts for major problems in the shower pipe manufacturing business. When plastic members 148 and 146 are assembled, they are sonically welded together one to the other. Therefore, the pipe members are not readily separable so that any damage to diffusion flange members requires that the pipe section surrounding the damaged member be cut out of the pipe. The missing area is then replaced by patching in a new flange member and pipe section. This replacement operation is typically conducted by the customer. Since the customer is not familiar with the proper techniques for patching the replacement section, it takes up to about 2 hours to complete the patching operation. Patching also adversely affects the flow geometry of the new flange member since only a portion of the pipe underneath the flange member is replaced during that procedure. Replacement of the entire shower pipe, at an average cost to the customer of about $14,000, is needed when there is a change in the pulping production rate, or in the pulping process, or in governmental requirements. All of these changes require a corresponding change in the liquid flow rate from the flange member. This change can only be accomplished by the above-described shower pipe replacement.

Accordingly, there remains a need for a shower pipe which encompasses the improved features of U.S. Pat. No. 4,522,716, U.S. Pat. No. 4,670,099, U.S. Pat. No. 4,697,292, and U.S. Pat. No. 4,795,558, but which is capable of overcoming the above-described problems associated with those structures.

The foregoing and other objects, features and advantages of the invention will become more readily apparent from the following detailed description of a preferred embodiment which proceeds with reference to the drawings.

SUMMARY OF THE INVENTION

Figure 1:
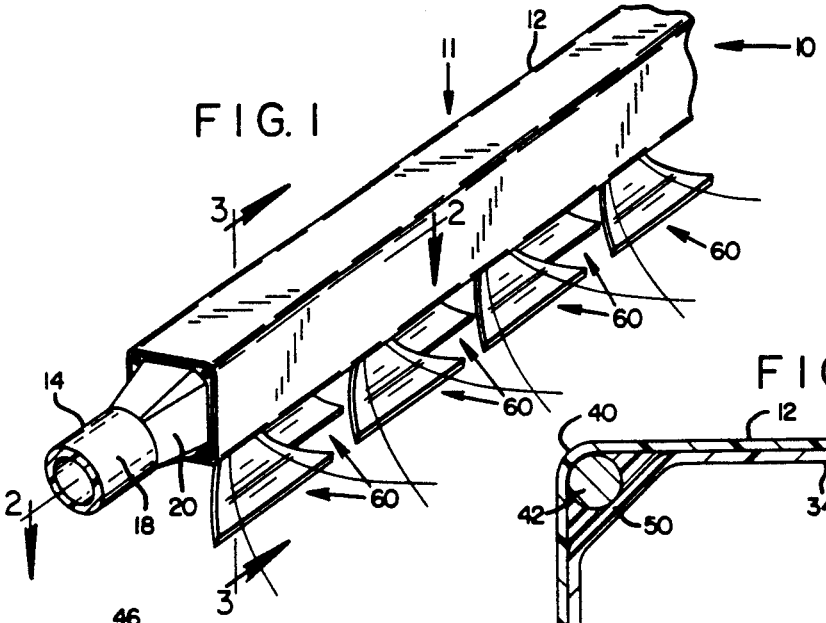
FIG. 1 is a perspective view of an improved shower pipe assembly of the present invention.

This invention relates to a shower pipe assembly which encompasses the pertinent improved features of U.S. Pat. No. 4,522,716, U.S. Pat. No. 4,670,099, U.S. Pat. No. 4,697,292, and U.S. Pat. No. 4,795,558, but which is capable of overcoming all of the above-described problems associated with those structures as hereinafter described.

More specifically, the subject shower pipe assembly is preferably fabricated of a corrosion-resistant material, and more preferably a corrosion-resistant polymeric material. It is also designed, particularly in hereinafter described unitary, single-piece configuration, to provide a structurally sound pipe design and to thereby prevent substantial sagging of the shower pipes.

Because of the external attachable design of the spray flange assembly to the shower pipe member, the pipe does not have to be produced in multiple sections which are subsequently assembled. Instead, the shower pipe member can be manufactured in a rigid, unitary, single-piece form thereby eliminating the problems associated with shower pipes formed in sections and bonded together along flanges. These single-piece pipe members are less expensive to build and at the same time overcome the previously described burst strength problems. Furthermore, the disadvantages associated with diffusion flanges which are internally-mounted have also been overcome. For example, if any of the externally-attached diffusion flange assemblies are damaged, it can easily be replaced without requiring the end user to remove the damaged spray flange assembly and surrounding pipe section and replace same employing unfamiliar patching techniques. Since the subject replacement operation is conducted without removing any portion of the pipe itself, the flow geometry of the wash liquid remains unchanged. Furthermore, as hereinafter described, if a different flow rate is required because of changes in production rate, pulping process or governmental requirements, a new spray flange assembly having a larger or smaller flow spray channel is merely substituted for the old spray flange assembly. This avoids the need to replace the entire shower pipe assembly thereby reducing the cost.

The shower pipe assembly of the present invention can be used in a washing device such as a rotary drum filter and comprises an elongate pipe member including means defining a hollow interior flow chamber, preferably located adjacent a washer device, for conveying a wash liquid, preferably a liquid for washing a pulp mat. The shower pipe includes means defining at least one row of spray holes extending through the pipe from the interior flow chamber to the exterior thereof. It also comprises spray diffusion flange assembly means extending from the pipe member adjacent each of the spray holes and further includes means for impermanently attaching the diffusion flange means to, and detaching the diffusion flange means from, the pipe member, preferably to the exterior of the pipe member. These attachment and detachment steps are carried out without the use of auxiliary internal connecting means which are not part of the diffusion flange means structure. The shower pipe assembly of this invention includes spray diffusion flange means comprising a generally concave curved diffusion flange portion joined to an attachment portion for externally connecting the diffusion flange means within the pipe member spray hole means to the exterior of the pipe member. The spray diffusion flange means includes means defining a spray channel for discharging a liquid stream to the diffusion flange for dispersing a spray laterally from its associated spray hole. The external attachment member includes means defining a spray channel for discharging a liquid stream to the diffusion flange for dispersing a spray laterally from its associated spray hole. The size of the spray channel can determine the desired flow rate of the liquid stream. For instance, at the same flow rate of the liquid stream in the interior flow chamber, the flow rate of the emitted spray liquid will be increased if the size of the spray channel is increased, or decreased if the size of the spray channel is decreased.

The spray diffusion flange means also includes means for exerting externally-directed forces to the spray diffusion flange means for retaining the spray diffusion flange means within the pipe member spray hole means and for externally connecting same to the exterior of the pipe member. The retaining means typically comprises a compression collar which connects to the spray diffusion flange means for exerting the externally-directed forces thereto. The spray diffusion flange means includes means for moving the external attachment member through the spray holes into the interior flow channel but, once in position therewithin, impedes the movement of the spray diffusion flange member away from the shower pipe member.

The external attachment member can also include axial and radial indented portions which together define a shoulder which seats against the shower pipe member and within the spray holes. The external attachment member preferably further includes a shoulder section configured for securably engaging the retaining means for maintaining the spray diffusion flange member in a fixed, externally attached position with respect to pipe member 11, within the spray holes and against the pipe member.

DETAILED DESCRIPTION OF THE PREFERRED EMBODIMENT

Shower Pipe Member

Figure 2:
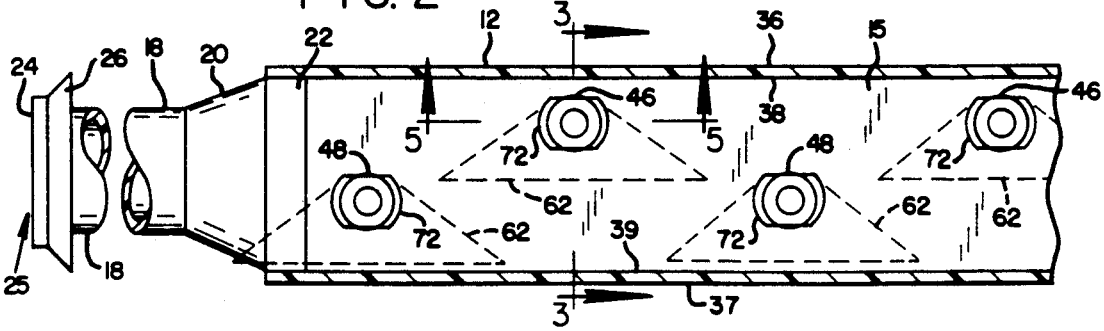
FIG. 2 is a vertical cross-sectional view taken along lines 2—2 of FIG. 1.

Referring to FIG. 1, shower pipe assembly 10 comprises a shower pipe member 11 having an elongated conduit or body 12 comprising a substantially rectangular cross-sectional configuration, preferably a square cross-sectional configuration, terminated at each end by a square-to-round reducer pipe 14. Referring to FIG. 2, shower pipe 10 is supported at each end by a bracket (not shown) structured to receive the cylindrical portion 18 of reducer 14. The bracket is conventionally arranged such as described in U.S. Pat. No. 4,795,558, to position pipe 11 a fixed distance from pulp mat 13 in FIG. 3, which is borne by the rotary drum (not shown) in a direction indicated in FIG. 3 by arrow 15. Connecting the cylindrical portion 18 of the reducer to the body of the shower pipe is a flared, square section 20, having a parallel-sided, square end portion 22 received within the end of body 12. A sealing flange 24 and backing ring 26 provide a sealed connection between the cylindrical end of the reducer pipe and a washing liquid input conduit (not shown).

Figure 3:
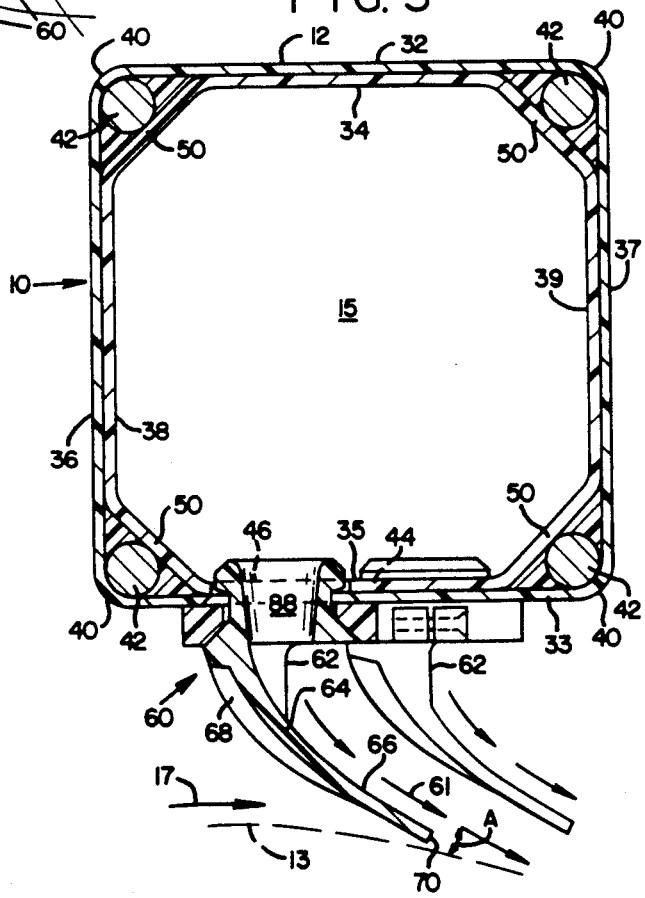
FIG. 3 is a cross-sectional view taken along lines 3—3 of FIG. 1.

Referring to FIG. 3, the shower pipe assembly 10 comprises a shower pipe body 11, formed in a single-piece unitary rectangular section, and a spray diffusion flange assembly 60. The assembled body 12 has a square cross section defined by top and bottom outer walls 32, 33 and inner walls 34, 35 sidewalls 36, 37 and inner sidewalls 38, 39 are generally rounded angle corners 40. Metal reinforcing rods 42 are positioned inside the shower pipe within the interior of each corner 40 and secured therein, such as by a reinforcing adhesive material 44, for example, an adhesive putty material or the like.

Figure 5:
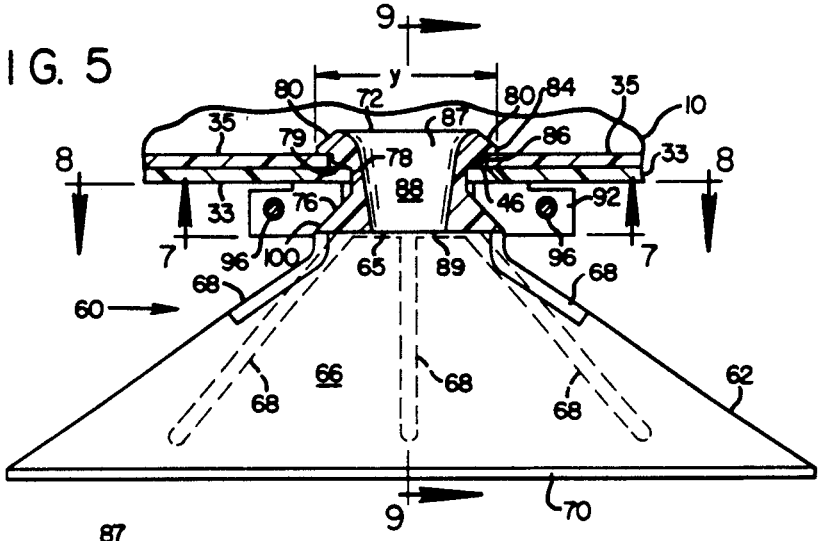
FIG. 5 is a cross-sectional view taken along lines 5—5 of FIG. 2.
Figure 6:
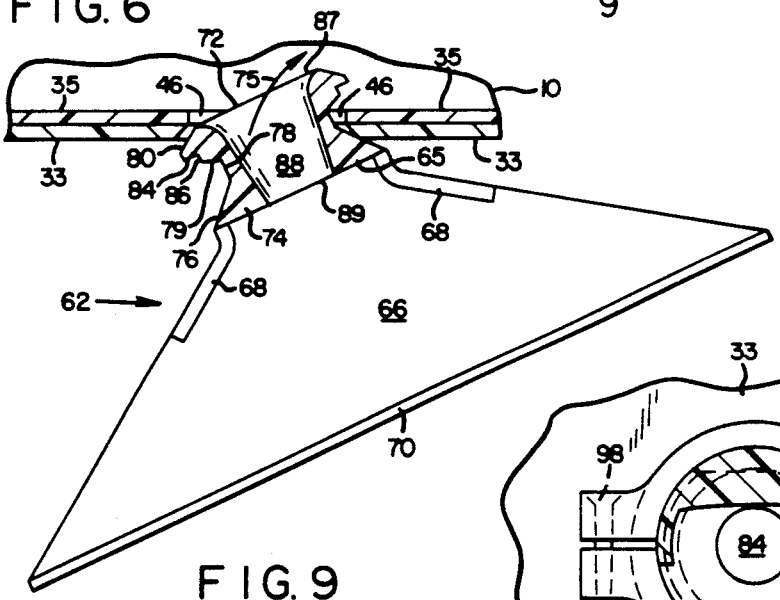
FIG. 6 is the diffusion flange assembly of FIG. 5 shown in position prior to external attachment within an opening in the shower pipe.
Figure 7:
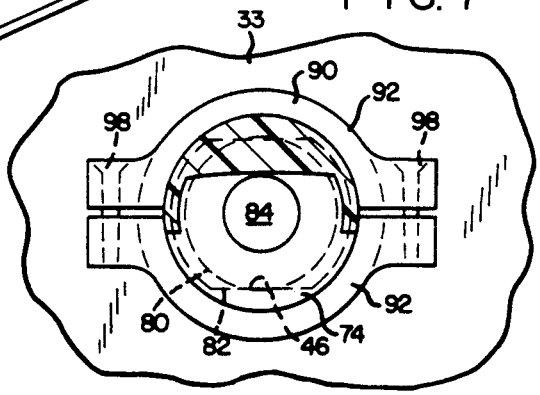
FIG. 7 is a sectional view taken along lines 7—7 of FIG. 5.

A spray discharge system is formed in the bottom walls 33, 35 of shower pipe body 12. This system includes two rows of outlet or spray holes 46, 48. These holes are closely spaced laterally of the pipe, as shown in FIG. 2. The holes are spaced longitudinally apart to accommodate the required flow rate. The holes are longitudinally staggered so that the holes in one row are positioned between, preferably halfway between, the holes of the other row, and spaced apart along the length of the pipe. Referring to FIGS. 5 and 6, the holes which are constructed to engage spray diffusion flange 60 are defined by bottom walls 33, 35. The specific holes depicted have a frustoconical-shaped outer portion and a cylindrically-shaped inner portion, respectively.

Fabrication Method for Shower Pipe Member

A typical method for fabricating single-piece, unitary shower pipe member 11 is as follows: A male mold is employed having a highly polished exterior surface and/or a mold release film covering on its exterior surface. The longitudinal dimension of the mold is sized to produce a shower pipe member of a requisite length. The cross sectional configuration of the male mold is generally octagonally-shaped. Typically, the four rectangular sides of the octagon are about 4½" in length, and the four generally angular sides are typically about 1⅛" in length.

First, the mold is wrapped with a single ply of "C" veil glass web such as "C" veil glass web F 2-30 manufactured by Regina Limited. Multiple plies of a chopped glass strand mat are then wrapped around the glass veil ply. The chopped strand mat can be the 1.5 oz. M113 chopped strand manufactured by Certainted. The plies of glass veil and chopped strand mat are then saturated with a resinous material in liquid form. A typical resin employed for this purpose is Hetron 922L, manufactured by Ashland Chemical Company. A laminate structure is produced of predetermined thickness when the set resinous material completes its curing process. This forms the inner wall of the shower pipe 11 comprising top and bottom inner walls 34, 35 and inner sidewalls 38, 39, respectively. Next, metal reinforcing rods 42 are positioned on the inner wall structure at the respective corner flats 50 which face the angular portions of the shower pipe member mold. The reinforcing bar 42 is preferably made of steel which is formed into a bar of varying cross sectional shapes such as a round bar, a half-round bar, or even a concrete re-bar. Next, the metal reinforcing rods 42 are secured in position using a reinforcing adhesive material 44. Adhesive material 44 is employed for securing in place rods 42 and for forming a smooth, contoured rounded corner. Next, the reinforcing bar 42 is encapsulated by first wrapping the entire formed unit with three plies of a chopped strand glass mat, and saturating the mat with resin as described with respect to the formation of the inner wall of the shower pipe member. This laminate structure is allowed to cure and to form the outer wall of shower pipe 11 which comprises top and bottom outer walls 32, 33 and outer sidewalls 36, 37, respectively. The shower pipe body is removed from about the male mold, is trimmed to the desired longitudinal dimension, and the exterior wall is painted with a protective water-resistant coating. Spray holes 46, 48 are then drilled in the bottom wall so that it passes through both the bottom outer wall 33 and inner wall 35, respectively. Reducer pipe 14 is then installed at the opposite ends of shower pipe body 12. First, reducer pipe 14 is set in place within the ends of body 12 so that square end portion 22 is received within the end of body 12. Reducer pipe 14 is then overlaid with multiple plies of chopped strand mat saturated with resin. After the resin has been allowed to cure, reducer pipe 14 is ground smooth and painted.

The resulting shower pipe member 11 is reinforced at all corners so that it resists sagging regardless of orientation when in use. A major advantage of this invention, however, is that the shower pipe member is a single-piece unitary construction without any flange-to-flange attachment as is evident in prior patents of the assignee of this application. Most multi-section shower pipes fail in use at the point of attachment of the shower pipe sections. Accordingly, the above-described shower pipe member 11 is a substantial advance over counterpart shower pipes because of its unitary design.

Spray Diffusion Flange Assembly

FIGS. 4–9 depict a spray diffusion flange assembly 60 which is externally attachable to and detachable from shower pipe member 11. Spray diffusion flange assembly 60 comprises a spray diffusion flange member 62 and a retaining means in the form of a compression collar 90. The spray diffusion flange member 62 can be formed as a single, preformed injection-molded polymeric member, or can be separately preformed injection-molded polymeric members which are subsequently joined together.

Figure 4:
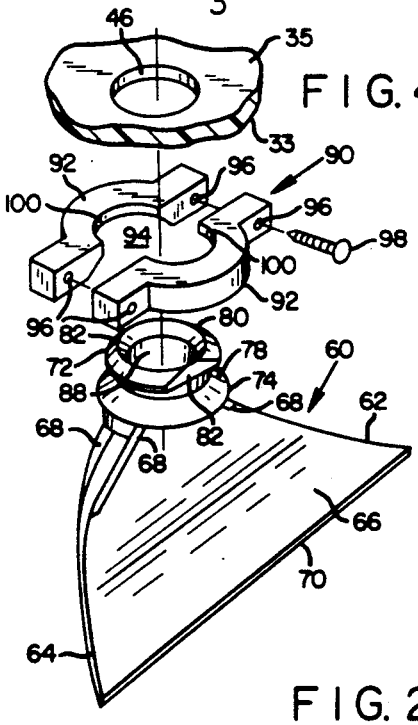
FIG. 4 is a perspective exploded view of the externally-attachable diffusion flange in assembled form as connected to a shower pipe in FIG. 3.

As best seen in FIG. 4 and 5, diffusion flange member 62 includes a fan-shaped lip 64 joined at its upper end 65 to external attachment member 72. The diffusion lips 64 have diffusion surfaces 66 which are concave curved, and preferably parabolically curved, from their meeting with the lower bore walls of their respective spray holes. The pronounced fan shape of diffusion lips 64 provide a desired lateral dispersion of spray from the associated spray hole. The spread of the fan should be such that good lateral dispersion of spray is achieved without any overlapping of spray from adjacent spray holes in the same row. The lips terminate in a wide straight free end edge 70 which projects the spray from the lip substantially in a plane. A plurality of reinforcing ribs 68 extend from the upper end 65 toward the edge 70 to provide additional flexural strength for the flange member 62.

The external attachment member 72 comprises a shoulder section 74 joined at one end to the upper end 65 of diffusion flange member 62 and connected at its other end to one end of shank section 78. The shank section 78 is joined at its other end to protuberance section 80 by tapered shoulder 79 which acts as a centering device for positioning flange member 62 within spray holes 44, 46.

Shoulder section 74 has a frustoconical outer surface 76 which is configured to be securably engaged by compression collar 90, as hereinafter described, for purposes of retaining spray diffusion flange member 62 in a fixed, externally attached position with respect to pipe member 11, within spray holes 44, 46, and against bottom walls 33, 35. Therefore, the shoulder section 74 is located on the outside the shower pipe member 11.

Shank section 78 has a diameter which is smaller than the diameter of spray holes 44, 46. The diameter of shank section 78 is set to permit the protuberance section 80 to be readily maneuvered to a position within the interior 15 of pipe member 11 and seated against the interior bottom wall 35 in the direction of arrow 75 (see FIG. 6). When the external attachment member 72 is in fixed position with respect to pipe member 11, shank section 78 is located within spray holes 44, 46.

Figure 9:
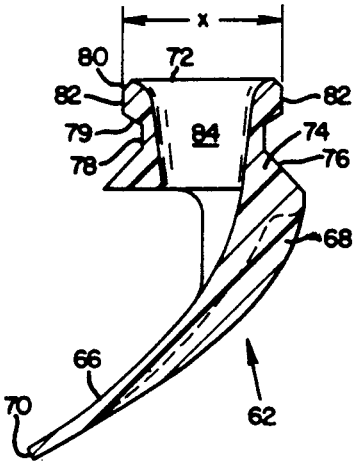
FIG. 9 is a sectional view of flange member 62 taken along lines 9—9 of FIG. 5.
Figure 8:
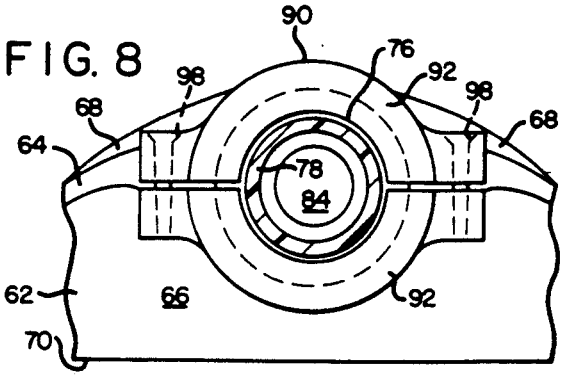
FIG. 8 is a sectional view taken along lines 8—8 of FIG. 5.

Protuberance section 80 is designed to be moved through holes 44, 46 and into pipe member interior 15 but, once in position therewithin, to impede the movement of spray diffusion flange member 62 away from shower pipe member 11. The diameter of the protuberance section 80 is greater than the diameter of the spray holes 44, 46 in order to impede flange member 62. However, the protuberance section 80 is further configured to allow external attachment within spray holes 44, 46 to be effected. Referring to FIGS. 4 and 9, this is accomplished by removing certain portions of the protuberance section 80 thus defining therein cutaway sections 82. The distance "x" between the respective sections 82 is less than diameter of the spray holes 44, 46 thereby permitting insertion of the protuberance section into the interior of the pipe member 11. Centering of the flange member 62 within spray holes 44, 46 is accomplished through the use of tapered shoulder 79. As best seen in FIGS. 5 and 6, the protuberance section 80 also include axial and radial indented or cut-away portions 84 and 86 together defining a shoulder which seats against inner bottom wall 35 and within spray holes 44, 46.

The attachment member 72 includes a spray channel 88 for transferring the spray liquid passing within the pipe member interior 15 to the spray diffusion lip 64. The spray channel 88 includes, for maintaining maximum fluid flow, an inlet portion 87 having a maximum diameter. Spray channel 88 is smoothly inwardly tapered at a decreasing diameter toward a minimum diameter at its outlet portion 89. By increasing the dimensions of the spray channel 88, a higher flow rate of spray liquid to the spray diffusion lip 64 can be effectively handled.

The compression collar 90, which is pictured in FIGS. 4, 5, 7 and 8, comprises complementary collar sections 92 which together form a compression collar member, having means defining a central opening 94 for receiving the external attachment member 72 and maintaining the spray diffusion flange member in a fixed seated position with respect to pipe member 11. Each of the complementary collar sections 92 includes a semi-annular portion 93 having flared end portions 95 at its opposite sides. The flared ends 95 have aligned threaded apertures 96 passing therethrough which receive screws 98 which hold sections 92 in adjacent complementary position. The interior edge of semi-annular portion 93 defines a frustoconical recess 100 which is of complementary configuration to the frustoconical outer surface of shoulder section 74 in order to facilitate engagement thereof.

Installation of shower Pipe Assembly

A plurality of spray diffusion flange assemblies 60 are attached to the exterior of each unitary, one-piece shower pipe 11 to the number of shower pipe assemblies 10 required to complete the hereinafter described rotary drum installation. As best seen in FIG. 6, the attachment process is initiated by inserting the external attachment member 72 of the spray diffusion flange assembly 60 into the pipe member 11. This is accomplished by moving the protuberance section 80 through spray hole 46 into pipe member interior 15 so that shank section 78 is within the confines of spray hole 46. In this position, the shoulder formed by axial and radial indented portions 84 and 86 seats against the bottom wall 35 within spray hole 46, and the frustoconical outer surface 76 is seated within spray holes 46 and against bottom walls 33, 35. The respective sections 92 compression collar 90 are then moved into position and frustoconical surface 100 is securably engaged about complementary frustoconical surface 76 of compression collar 90 by inserting screws 98 within threaded apertures 96. Tightening of the screws 98 urges the compression collar 90 inwardly, and in turn urges the spray flange member 62 outwardly, so that it seats and is in a fixed position externally attached against the outer bottom wall 33.

Shower pipe assemblies 10 can then be installed on a rotary drum filter by mounting its respective ends into bracket 16 and connecting same to a washing liquid input conduit (not shown). A plurality of such pipe assemblies will be installed and angularly spaced around a quadrant of the drum. Each pipe is connected to a liquid input manifold, of which the above-referenced washing liquid input conduit forms a single branch. Each pipe is rotationally positioned in its respective bracket 16 to discharge a spray in the direction of arrows 61 at a selected angle A from the mat 13. The mat 13 moves in the direction of arrow 17. Thus, pipe assembly 10 is rotationally positioned as shown in FIGS. 1 and 2, for use at the top or 12 o'clock position on the drum. Another such pipe located near the 9 o'clock position on the rim would be rotated counterclockwise nearly 90 degrees from the position shown in FIG. 2. In pipes located at intermediate positions, the flange assemblies 60 and the reinforcing rods 42 nearest to vertical alignment jointly stiffen the pipe. Shower pipe assembly 10, can support a load in addition to it's operating weight without substantial deflection or sag. Also, when operated within the normal range of thermal conditions, deflection or sag does not vary measurably.

Operation

In operation, washing fluid is introduced into the shower pipe through the conduit, as indicated by arrow 25. This liquid is discharged under pressure through spray channel 88. The discharge flow further diffuses laterally as it flows down spray diffusion surface 66, to form generally fan-shaped flow patterns 61. The combined action of the configuration of discharge holes, the parabolic shape of the diffusing surfaces, and the positioning of such surfaces immediately adjacent the holes, widely and uniformly disperses the discharge flow. The sprays from adjacent holes in the same row overlap much of the offset spray from a hole between them in the other row, but do not themselves overlap.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A shower pipe assembly for a washer device comprising:

an elongate pipe member including means defining a hollow interior flow chamber located adjacent said washer device for conveying a wash liquid;

means defining at least one row of spray holes extending through said pipe member from said interior flow chamber to the exterior of said pipe member for conveying said wash liquid from said interior flow chamber;

spray diffusion flange means extending from the pipe member adjacent each said spray hole, said spray diffusion flange means including indented portions which together define a shoulder for seating against said shower pipe member and within said spray holes;

means for impermanently attaching said spray diffusion flange means to, and detaching said spray diffusion flange means from, said pipe member, for spraying said wash liquid emitted from said spray holes for spraying said wash liquid; and a compression collar comprising a plurality of sections which connect and disconnect one from the other, said compression collar connecting to said spray diffusion flange means for exerting externally-directed forces to said spray diffusion flange means for retaining said spray diffusion flange means within said pipe member spray hole means and for externally attaching said spray diffusion flange means in a fixed position adjacent to the exterior of said pipe member.

2. The shower pipe assembly of claim 1, wherein said spray diffusion flange means is impermanently attached to the exterior of said pipe member.

3. The shower pipe assembly of claim 1, which comprises a rigid, one-piece, unitary member.

4. The shower pipe assembly of claim 1, wherein said spray diffusion flange means comprises a generally concavely curved diffusion flange portion and an attachment portion joined one to the other for externally connecting said spray diffusion flange means within said pipe member spray hole means to the exterior of said pipe member.

5. The shower pipe assembly of claim 1, wherein said spray diffusion flange means includes means defining a spray channel for discharging a liquid stream through said spray diffusion flange means for dispersing a spray laterally passing from its associated spray hole.

6. The shower pipe assembly of claim 1, which further includes means for exerting externally-directed forces to said spray diffusion flange means thereby retaining said spray diffusion flange means within said pipe member spray hole means and externally connecting said spray diffusion flange means in a fixed position adjacent to the exterior of said pipe member.

7. The shower pipe assembly of claim 6, wherein said means for exerting externally-directed forces to said spray diffusion flange means comprises a compression collar which connects to said spray diffusion flange means thereby, exerting externally-directed forces thereto and retaining said spray diffusion flange means within said pipe member spray hole means.

8. The shower pipe assembly of claim 6, wherein said means for exerting externally-directed forces to said spray diffusion flange means includes a shoulder section configured to securably engage said retaining means for maintaining said spray diffusion flange means in a fixed, externally attached position with respect to said pipe member within said spray holes and against said pipe member.

9. The shower pipe assembly of claim 6, wherein said means for exerting externally-directed forces for said spray diffusion flange means includes means defining a variable sized spray channel for discharging said spray to said diffusion flange for dispersing a spray laterally from its associated spray hole.

10. The shower pipe assembly of claim 1, wherein said spray diffusion flange means includes means for permitting movement of said spray diffusion flange means through said spray holes into said interior flow channel but, once in position therewithin, which impedes the movement of said diffusion flange means with respect to said shower pipe member.

11. A washer device for conveying a wash liquid, said wash device including a shower pipe assembly, said shower pipe assembly comprising:

an elongate pipe member including means defining a hollow interior flow chamber located adjacent said washer device for conveying a wash liquid;

means defining at least one row of spray holes extending through said pipe member from said interior flow chamber to the exterior of said pipe member for conveying said wash liquid from said interior flow chamber;

spray diffusion flange means extending from the pipe member adjacent each said spray hole, said spray diffusion flange means including indented portions which together define a shoulder for seating against said shower pipe member and within said spray holes;

means for impermanently attaching said spray diffusion flange means to, and detaching said spray diffusion flange means from, said pipe member, for spraying said wash liquid emitted from said spray holes for spraying said wash liquid; and a compression collar comprising a plurality of sections which connect and disconnect one from the other, said compression collar connecting to said spray diffusion flange means for exerting externally-directed forces to said spray diffusion flange means for retaining said spray diffusion flange means within said pipe member spray hole means and for externally attaching said spray diffusion flange means in a fixed position adjacent to the exterior of said pipe member.

12. The washer device assembly of claim 11, wherein said spray diffusion flange assembly is impermanently attached to the exterior of said pipe member.

13. The shower pipe assembly of claim 11, wherein said pipe comprises a rigid, one-piece, unitary member.

14. The shower pipe assembly of claim 11, which comprises a generally concave curved diffusion flange portion joined to an attachment portion for externally attaching said diffusion flange means within said pipe member spray hole means to the exterior of said pipe member.

15. The shower pipe assembly of claim 11, wherein said diffusion spray flange means includes means defining a spray channel for discharging a liquid stream to said diffusion flange for dispersing a spray laterally from its associated spray hole.

16. The shower pipe assembly of claim 11, wherein said attachment portion includes means defining a spray channel for discharging said wash liquid stream to said diffusion flange for dispersing said liquid stream laterally from its associated spray hole, the size of said spray channel depending on the desired flow rate of said liquid stream.

17. The shower pipe assembly of claim 11, wherein said spray diffusion flange member includes means in said external attachment member for permitting movement of said spray diffusion flange member through said spray holes into said interior flow channel but, once in position therewithin, which impedes the movement of said spray diffusion flange member with respect to said shower pipe member.

* * * * *

UNITED STATES PATENT AND TRADEMARK OFFICE

CERTIFICATE OF CORRECTION

PATENT NO. : 5,028,007
DATED : July 2, 1991
INVENTOR(S) : Keith A. Wokal

It is certified that error appears in the above-indentified patent and that said Letters Patent is hereby corrected as shown below:

| | |
|---|---|
| Column 12 | Line 62, change "shower pipe" to --washer device--; |
| Column 12 | Line 52, change "shower pipe" to --washer device--; |
| Column 12 | Line 57, change "shower pipe" to --washer device--; |
| Column 13 | Line 1, change "shower pipe" to --washer device--; |

Signed and Sealed this

Fifth Day of April, 1994

Bruce Lehman

*Attest:*

BRUCE LEHMAN

*Attesting Officer*

*Commissioner of Patents and Trademarks*